US009295991B2

(12) United States Patent
Hartl et al.

(10) Patent No.: US 9,295,991 B2
(45) Date of Patent: Mar. 29, 2016

(54) JAW CRUSHER

(75) Inventors: Stefan Hartl, Au/Donau (AT); Paul Voithofer, Steyr (AT)

(73) Assignee: The Standard—standardized crushing and screening plants GmbH, Au an der Donau (AT)

( * ) Notice: Subject to any disclaimer, the term of this patent is extended or adjusted under 35 U.S.C. 154(b) by 314 days.

(21) Appl. No.: 13/699,765

(22) PCT Filed: Mar. 11, 2011

(86) PCT No.: PCT/AT2011/000126

§ 371 (c)(1),
(2), (4) Date: Dec. 19, 2012

(87) PCT Pub. No.: WO2011/109850

PCT Pub. Date: Sep. 15, 2011

(65) Prior Publication Data

US 2013/0099038 A1 Apr. 25, 2013

(30) Foreign Application Priority Data

Mar. 11, 2010 (AT) ..... A 391/2010

(51) Int. Cl.

| | |
|---|---|
| ***B02C 1/04*** | (2006.01) |
| *B02C 1/02* | (2006.01) |
| *B02C 1/08* | (2006.01) |

(52) U.S. Cl.

CPC . *B02C 1/04* (2013.01); *B02C 1/025* (2013.01); *B02C 1/02* (2013.01); *B02C 1/08* (2013.01)

(58) Field of Classification Search

CPC ..... B02C 1/02; B02C 1/025; B02C 1/04; B02C 1/08

USPC ..... 241/198.1, 259.1, 262, 264, 268, 269, 241/286, 287, 289, 290

See application file for complete search history.

(56) References Cited

U.S. PATENT DOCUMENTS

| | | | | |
|---|---|---|---|---|
| 1,620,078 | A * | 3/1927 | Cookinham | 241/268 |
| 2,554,697 | A * | 5/1951 | Conway | 241/94 |

(Continued)

FOREIGN PATENT DOCUMENTS

| | | | | |
|---|---|---|---|---|
| DE | 30 25 403 | | 1/1981 | |
| DE | 10206709 | A1 * | 8/2003 | B02C 1/04 |

(Continued)

OTHER PUBLICATIONS

English machine translation for DE 10206709 A1.*

(Continued)

*Primary Examiner* — Alexander P Taousakis
*Assistant Examiner* — Leonel Vasquez
(74) *Attorney, Agent, or Firm* — Collard & Roe, P.C.

(57) ABSTRACT

A jaw crusher includes a crushing chamber between a fixed jaw and a swing jaw. The jaw crusher also includes an eccentric drive which supports the first end of the swing jaw. The second end of the swing jaw is supported on a rocker plate. The counter-bearing of the rocker plate is arranged as a cross-member and is supported on a hydraulic overload protection mechanism. The cross-member is retained in lateral rocker arms held coaxially to the eccentric shaft of the eccentric drive. The lever axis of the rocker plate projects in a direction of the eccentric shaft and with this projection encloses an acute angle with a radial line of the eccentric shaft. The radial line passes through the counter-bearing of the rocker plate.

2 Claims, 1 Drawing Sheet

(56) References Cited

U.S. PATENT DOCUMENTS

| | | | | |
|---|---|---|---|---|
| 3,918,648 | A * | 11/1975 | Anthony | 241/32 |
| 4,361,289 | A | 11/1982 | Georget et al. | |
| 4,406,416 | A * | 9/1983 | Tateishi | 241/269 |
| 4,749,132 | A * | 6/1988 | Hagiwara et al. | 241/30 |
| 4,927,089 | A * | 5/1990 | Altmayer | 241/264 |
| 5,799,888 | A * | 9/1998 | Hamaguchi et al. | 241/259.1 |
| 6,644,577 | B2 * | 11/2003 | Togashi et al. | 241/264 |
| 6,932,289 | B2 * | 8/2005 | Musil | 241/264 |
| 7,168,644 | B2 * | 1/2007 | Togashi et al. | 241/268 |
| 7,341,213 | B2 * | 3/2008 | Boast | 241/264 |
| 7,344,097 | B2 * | 3/2008 | Young et al. | 241/37 |
| 7,614,573 | B1 * | 11/2009 | Jean | 241/264 |
| 7,686,241 | B2 * | 3/2010 | Nakayama et al. | 241/101.74 |
| 2006/0202075 | A1 * | 9/2006 | Young et al. | 241/264 |
| 2014/0048636 | A1 * | 2/2014 | Zhu | 241/267 |

FOREIGN PATENT DOCUMENTS

| | | | | |
|---|---|---|---|---|
| EP | 1 494 810 | | 11/2008 | |
| JP | 2004167443 | A * | 6/2004 | B02C 1/02 |

OTHER PUBLICATIONS

International Search Report of PCT/AT2011/000126, Jul. 14, 2011.

* cited by examiner

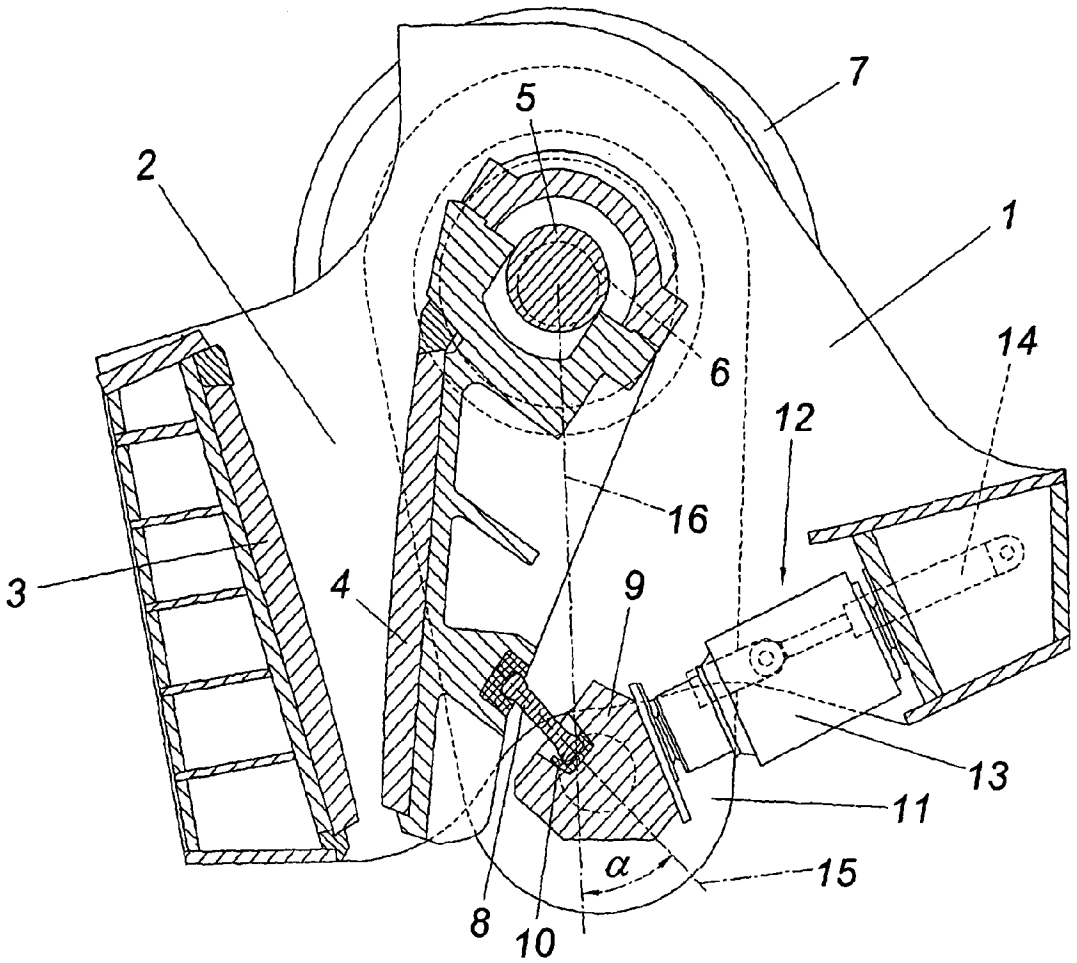
1
2
3
4
5
6
7
8
9
10
11
12
13
14
15
16
α

JAW CRUSHER

CROSS REFERENCE TO RELATED APPLICATIONS

This application is the National Stage of PCT/AT2011/000126 filed on Mar. 11, 2011, which claims priority under 35 U.S.C. §119 of Austrian Application No. A 391/2010 filed on Mar. 11, 2010. The international application under PCT article 21(2) was not published in English.

FIELD OF THE INVENTION

The invention relates to a jaw crusher that includes a crushing chamber between a fixed jaw and a swing jaw, and that includes an eccentric drive for the swing jaw. The swing jaw has a first end and a second end disposed opposite from the first end. The first end of the swing jaw is connected to the eccentric drive. The second end of the swing jaw is supported on a rocker plate. A cross member includes a counter-bearing for the rocker plate and is supported on a hydraulic overload protection mechanism.

DESCRIPTION OF THE PRIOR ART

In order to protect a jaw crusher from overload by unbreakable material, it is known (EP 1 494 810 A1) to support the swing jaw, which is disposed opposite of the fixed jaw of the crushing chamber and is driven by means of an eccentric drive, via a rocker plate on a cross-member. The swing jaw is supported on the rocker plate on the jaw end opposite of the eccentric drive. The cross-member forms a counter-bearing for the rocker plate and is held in its working position by a hydraulic overload protection mechanism. The overload protection mechanism is formed by two cylinder-piston units which support the cross-member against displacement and, therefore, against expanding the crushing gap between the swing jaw and the fixed jaw. The overload protection mechanism will respond when the hydraulic pressure in the cylinder piston units exceeds an upper threshold value, so that the cross-member is able to displace the pistons by displacement of the hydraulic medium in the cylinders. It is disadvantageous in these known jaw crushers for example that the effective crushing forces need to be dissipated by the cylinder-piston units of the overload protection mechanism onto the frame of the jaw crusher, which places special constructional demands on the overload protection mechanism. It is further difficult to newly set the crushing gap between the fixed jaw and the swing jaw after a response of the overload protection mechanism.

SUMMARY OF THE INVENTION

The invention is therefore based on the object of arranging a jaw crusher of the kind mentioned above in such a way that an overload protection mechanism can be ensured which is effective without any limits and without requiring the build-up of the full supporting forces for the swing jaw via the overload protection mechanism.

This object is achieved in accordance with the invention in such a way that the cross-member which forms the counter-bearing for the rocker plate is retained in lateral rocker arms that are held coaxially to the eccentric shaft of the eccentric drive. The lever axis of the rocker plate has a projection in a direction of the eccentric shaft. The projection of the lever axis encloses an acute angle with a line that is radial to the eccentric shaft. The radial line passes through the counter-bearing of the rocker plate.

As a result of these measures, a force is obtained via the rocker plate on the cross-member forming the counter-bearing for the rocker plate, which force has a force component which is radial with respect to the eccentric shaft depending on the angular position of the rocker plate in relation to the rocker arms accommodating the cross-member, so that a partial load corresponding to that radial force component is absorbed via the rocker arms to the eccentric shaft and therefore to the frame of the jaw crusher. This means that it is merely necessary to support the torque exerted on the rocker arms in relation to the frame via the hydraulic overload protection mechanism. Since this torque only originates from one force component which is disposed perpendicularly to the force component of the crushing forces to be absorbed, which force component is radial to the eccentric shaft, the overload protection mechanism is subjected to respectively low forces, which inevitably provides advantageous constructional conditions for the overload protection mechanism.

The arrangement of the cross-member to be retained in lateral rocker arms, which cross-member forms a counter-bearing for the rocker plate, further offers advantageous constructional preconditions for setting the crushing gap after triggering the overload protection mechanism, because the crushing gap can be reset in a simple manner by means of a hydraulic actuating drive for the rocker arms. It is obvious that the hydraulic actuating drive must not obstruct the overload protection mechanism. Accordingly, the hydraulic actuating drive will only be subjected to the pressure medium when a respective setting of the crushing gap is required. The support of the swing jaw in the preset crushing gap occurs via the rocker plate and the cross-member by means of the overload protection mechanism.

BRIEF DESCRIPTION OF THE DRAWING

The subject matter of the invention is shown in the drawing by way of example, which shows a jaw crusher in accordance with the invention in a schematic longitudinal sectional view.

DESCRIPTION OF THE PREFERRED EMBODIMENT

The illustrated jaw crusher includes a frame 1 which forms a crushing chamber 2 between a jaw 3 fixed to the frame and a swing jaw 4. The swing jaw 4 forms a crushing gap via the gap between itself and the fixed jaw 3. The crushing gap tapers with the fixed jaw 3 in the direction of the throughput of the crushing material. The swing jaw 4 is held on the eccentric 5 of the eccentric shaft 6 of an eccentric drive 7 and is supported on a rocker plate 8. At one of the ends of the swing jaw 4, the swing jaw 4 is supported at the eccentric drive. At the opposite end of the swing jaw 4, the swing jaw 4 is supported on the rocker plate 8. The rocker plate has its counter-bearing 10 in a cross-member 9. The cross-member 9 is held in lateral rocker arms 11 which are rotatably mounted on the eccentric shaft 6 of the eccentric drive 7. A hydraulic overload protection mechanism 12 is used for the torque support of the rocker arms 11 in relation to the frame 1, which overload protection mechanism includes at least one cylinder-piston unit 13 and is supported according to the illustrated embodiment on the cross-member 9, which supporting is not mandatory however because the overload protection mechanism 12 can also act on the rocker arms 11. Once the pressure in the hydraulic cushion which supports the piston in the cylinder-piston unit 13 exceeds an upper threshold value, a safety valve will open so that the cross-member can be displaced via pivoting of the rocker arms 11. This displacement causes an expansion of the crushing gap between the two jaws 3, 4 and protects against overload of the jaw crusher in those instances when the forces of the fixed jaw 3 and the swing jaw 4 are insufficient to crush an object.

In order to enable resetting of the crushing gap to its original size again after actuation of the overload protection mechanism 12, an actuating cylinder 14 is provided between the frame 1 and at least one of the two rocker arms 11. The actuating cylinder 14 will pivot back the rocker arms 11 to the initial position when the actuating cylinder 14 is subjected to a pressure medium, so that the cylinder-piston unit 13 can be blocked again in this position by the safety valve.

As is shown in the drawing, the lever axis 15 of the rocker plate 8 extends in a projection in the direction of the eccentric shaft 6 under an acute angle $\alpha$ in relation to a radial line 16 to the eccentric shaft 6. The radial line 16 passes through the counter-bearing 10. This arrangement with the accompanying acute angle means that the crushing forces acting in the direction of the lever axis 15 on the cross-member 9 and therefore on the rocker arms 11 have a force component which is radial to the eccentric shaft 6 and a force component which is perpendicularly thereto. The perpendicular force component determines the torque load of the rocker arms 11, so that it is merely necessary to support the torque load via the overload protection mechanism 12 in relation to the frame 1. The partial load determined by the radial force component will be absorbed directly via the rocker arms 11 and their bearing onto the frame 1. This direct absorption of the radial force component means that relatively low supporting forces can be expected for the overload protection mechanism 12, which enables simple constructional conditions for the overload protection mechanism 12.

The invention claimed is:

1. A jaw crusher comprising:

a frame;

an eccentric drive connected to the frame and comprising an eccentric shaft;

a fixed jaw fixed to the frame;

a swing jaw disposed with respect to the fixed jaw to form a crushing chamber between the fixed jaw and the swing jaw, having a first end connecting the swing jaw to the eccentric drive, and having a second end longitudinally opposite from the first end, objects being crushable in the crushing chamber by being pushed on one side via the fixed jaw and by being pushed on the opposite side via the swing jaw;

a rocker plate supporting the second end of the swing jaw and forming a lever having a lever axis;

a first lateral rocker arm and a second lateral rocker arm held coaxially to the eccentric shaft and rotatably mounted to the eccentric shaft;

a cross member comprising a counter-bearing accommodating the rocker plate, the cross member being retained by the first and second lateral rocker arms; and a hydraulic overload protection mechanism supported by the frame and supporting the cross member or at least one of the first and second lateral rocker arms;

wherein the lever axis of the rocker plate runs through the rocker plate downwards from the swing jaw towards the cross member;

wherein a radial line running radially from the eccentric shaft passes through the counter-bearing; and wherein in a direction facing an inlet of the crushing chamber and in a direction facing the swing jaw the radial line and the lever axis of the rocker plate enclose an acute angle.

2. The jaw crusher according to claim 1, further comprising a hydraulic actuating drive connected to the frame and to the first lateral rocker arm;

wherein the hydraulic actuating drive is configured to pivot the first lateral rocker arm to displace the cross member to displace the rocker plate to displace the swing jaw to adjust a distance between the swing jaw and the fixed jaw upon actuation of the hydraulic actuating drive.

* * * * *